United States Patent [19]

Loomis

[11] Patent Number: 4,922,988

[45] Date of Patent: May 8, 1990

[54] TENSION MOUNTING SYSTEM AND ASSEMBLY

[75] Inventor: Russell M. Loomis, Palos Heights, Ill.

[73] Assignee: Aero Wabash, Inc., Indianapolis, Ind.

[21] Appl. No.: 309,206

[22] PCT Filed: Sep. 20, 1988

[86] PCT No.: PCT/US88/03168

§ 371 Date: Nov. 18, 1988

§ 102(e) Date: Nov. 18, 1988

[87] PCT Pub. No.: WO89/02495

PCT Pub. Date: Mar. 23, 1989

Related U.S. Application Data

[63] Continuation-in-part of Ser. No. 131,217, Dec. 8, 1987, which is a continuation-in-part of Ser. No. 99,056, Sep. 21, 1987, Pat. No. 4,800,947.

[51] Int. Cl.[5] ..... B44D 3/18

[52] U.S. Cl. ..... 160/368.1; 160/378; 38/102.1; 40/603

[58] Field of Search ..... 160/368.1, 371, 378, 160/375; 38/102.1, 102.91; 248/231.4, 231.1, 488; 40/603

[56] References Cited

U.S. PATENT DOCUMENTS

| | | | |
|---|---|---|---|
| 3,126,332 | 3/1964 | Salete | 160/378 X |
| 3,485,165 | 12/1969 | Hughes | 160/378 X |
| 3,553,862 | 1/1971 | Hamu | 38/102.1 |
| 4,041,861 | 8/1977 | Alter | 38/102.91 X |
| 4,265,039 | 5/1981 | Brooks | 38/102.91 X |
| 4,372,071 | 2/1983 | Vicino . | |
| 4,450,000 | 6/1984 | Gandy . | |

*Primary Examiner*—Blair M. Johnson

*Attorney, Agent, or Firm*—Laubscher, Presta and Laubscher

[57] ABSTRACT

A tension mounting system and assembly for suspending a flexible sheet material in a taut condition from a generally planar support surface and providing selective tension adjustment of the flexible sheet material is provided. The mounting system and assembly is especially suitable for use in signs displaying advertising material, such as billboards, signboards, and the like.

10 Claims, 12 Drawing Sheets

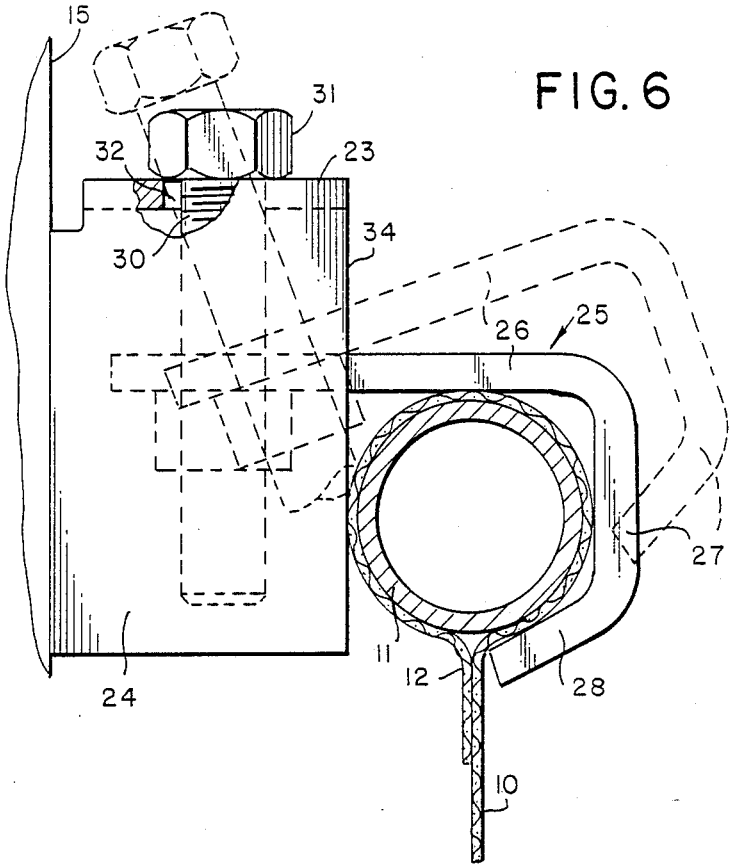
FIG. 6
FIG. 9
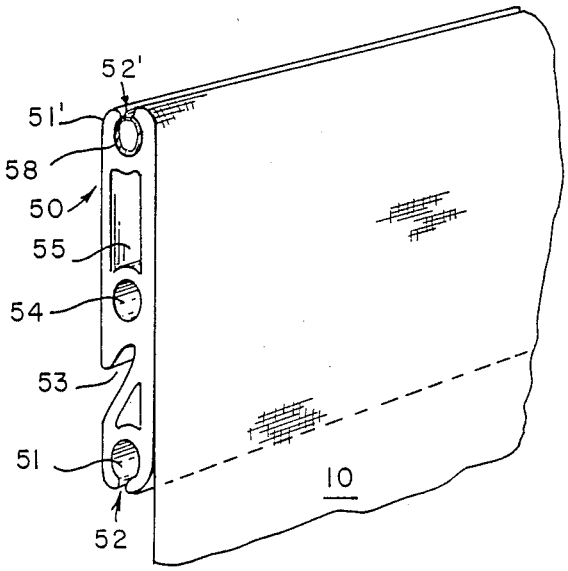

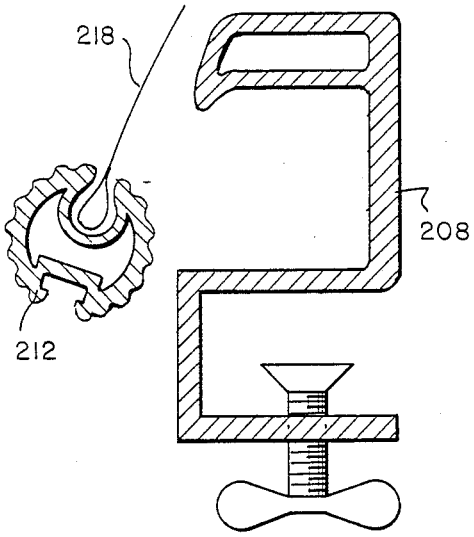
FIG. 29
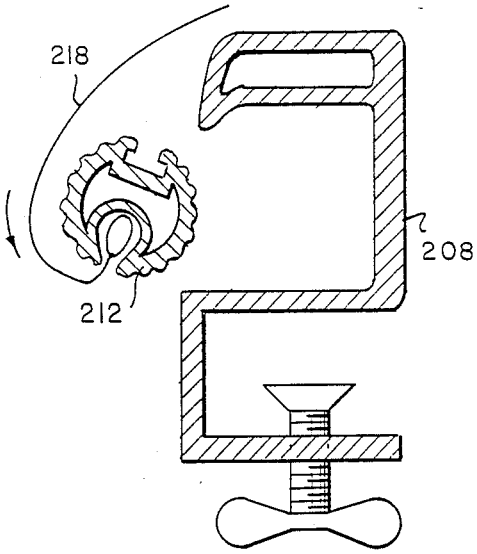
FIG. 30
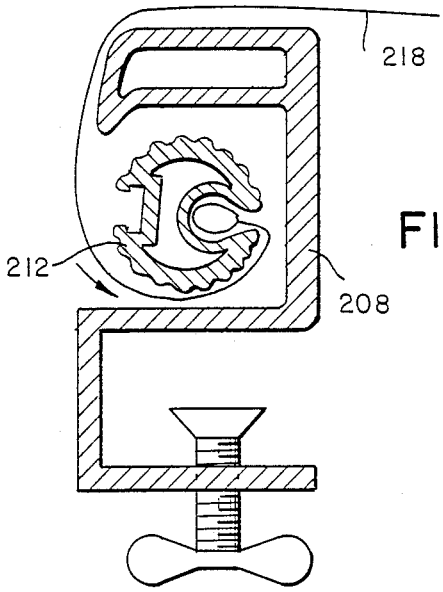
FIG. 31
FIG. 32
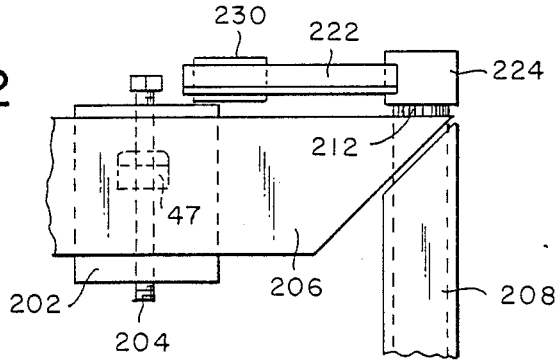

TENSION MOUNTING SYSTEM AND ASSEMBLY

This application is a continuation-in-part of application Ser. No. 131,217 filed Dec. 8, 1987 which is a continuation-in-part of application Ser. No. 099,056 filed Sept. 21, 1987 U.S. Pat. No. 4,800,947.

Background of the Invention

1. Field of the Invention

The present invention relates to a tension mounting system and assembly whereby a flexible sheet material may be suspended in a taut condition from a generally planar support surface. The mounting system and assembly of the present invention is particularly suitable for use in signs displaying advertising material, such as billboards, signboards, and the like.

2. Description of the Prior Art

Display signs have been used for a variety of purposes and in a variety of applications, typically for promoting a business or a product. Conventional billboards generally comprise a planar rigid support surface, or a plurality of such surfaces mounted adjacent one another, upon which the advertising message is painted. Alternatively, the advertising material may be painted or printed on paper or another sheet-like material which is then affixed to the planar rigid support surface, typically by means of adhesives. In many cases, the billboard comprises a freestanding structure mounted on the ground or on a building or the like, and it may be illuminated by spotlights, or the like, to provide visibility during the night. In some cases, advertising material is applied directly to the surfaces of a building structure itself because the building structure cannot support the weight of a billboard support structure. These types of conventional billboards are very expensive to erect and maintain because preparation and maintenance, in particular, are labor intensive operations. The appearance of conventional billboards is also apt to deteriorate rapidly due to weather conditions such as sun, precipitation, changes in temperature, and the like.

Signs comprising a substantially rigid sheet of transparent or translucent material upon which an advertising message has been applied have also been utilized, generally by mounting them in a cabinet and illuminating the sheet material bearing the advertising message from inside the cabinet. These types of display signs generally exhibit less deterioration due to weather conditions, but the size of the display signs is quite limited, since transport and installation of a large, substantially rigid sheet is impracticable. In addition, these materials exhibit at least some resiliency, which limits the practical dimensions of the sign, and tends to result in distortion or bowing of the sign due to the weight of the material and due to adverse weather conditions, such as high winds.

Recent innovations in the advertising industry include the use of a flexible, fabric-like sheet material which is light, relatively impervious to weather, and may be illuminated from behind to provide an attractive and effective display. This material is preferably suspended in a taut condition to provide a planar display surface. The costs associated with installation and maintenance of display signs comprising a flexible sheet material are generally less than those associated with conventional signboards and billboards, since the advertising message may be applied at a central location, and the sheet material may be rolled or folded for convenient transport to the display location. The flexible fabric-like sheet material may be applied over or suspended from a conventional billboard support surface or a building support structure.

Means for mounting and/or framing flexible paper and synthetic sheet-like materials are known to the art. U.S. Pat. No. 2,212,313 teaches a display panel wherein a flexible, replaceable cover is mounted to a rigid rail at each longitudinal edge, and the longitudinal edges are wrapped around upright tubular structures and anchored to cross members by means of springs. U.S. Pat. No. 2,533,565 teaches a display frame for retaining a flexible display panel in a taut condition generally parallel to a backing board by means of spring clips along one edge and rigid clips along the opposite edge. U.S. Pat. No. 3,591,940 teaches a supporting frame for releasably clamping flexible sheet materials, such as posters, to the frame means. The poster is fastenable to opposite frame members by clamp means and a spring may be wedged between the frame members to provide the desired tension. U.S. Pat. No. 3,758,972 teaches a sign housing with a removably mounted sign panel wherein the edges of the sign sheet and a protective cover sheet are retained between nesting members of the panel frame. U.S. Pat. No. 3,830,278 teaches a modular canvas stretcher wherein canvas is fastened to the stretcher frame comprising rigid, mitered elongated members having longitudinal channels for retaining bracket members and bracing members. U.S. Pat. No. 4,233,765 teaches a peripheral framework for suspending flexible sheet materials over a central open area. The peripheral framework is provided with a channel for receiving a flexible strip member, by which the flexible material is engaged between the channel and the strip member.

U.S. Pat. No. 4,317,302 teaches a sign cabinet for outdoor signs comprising a support frame with clamp assemblies for retaining a flexible sign face under tension. U.S. Pat. No. 4,452,000 teaches an illuminatable sign and framework housing therefor, wherein a sheet of flexible, light-transmitting material extends across and covers an opening, and bolts secure a peripheral marginal portion of the sheet by adjustably tensioning the sheet across the opening. U.S. Pat. No. 4,372,071 teaches a fabric faced billboard wherein air pressure is applied from behind the fabric to smooth the fabric and provide a continuous, slightly curved display face.

U.S. Pat. No. 4,265,039 teaches a framework for suspending a fabric display face and a clamp assembly for selective adjustment of fabric tension. The '039 patent teaches that prior art clamp assemblies required spaced holes to be punched in the fabric display through which bolts of the clamp assemblies were passed. The clamp assemblies were tightened around the fabric by means of a first nut, and the fabric was then tensioned by means of a second nut drawing the suspended clamp toward the mounted bracket. This system is undesirable from the standpoint that a plurality of holes are required in the fabric sign at prescribed intervals, and the fabric sign is prone to tearing during installation. In addition, multiple adjustments of the multiplicity of clamp assemblies to first tighten the clamp assembly around the fabric and then tension the fabric, is tedious and time consuming. The '039 patent teaches a fastening assembly having upper and lower support elements joined between corresponding opposite ends by respective side support elements. A hinge element is affixed to at least one of the support elements, and a hinge pin to which a marginal portion of the fabric is coupled may undergo limited rotation in conjunction with the hinge element to provide selective adjustment of the tension induced in the fabric.

U.S. Pat. No. 4,657,062 teaches an adjustable clamping system for tensioning and locking a flexible tarp. The '062 patent teaches a roll bar for fastening an edge of the flexible tarp to the clamping means. Roll bars of this type having a groove for retaining an enlarged or supported edge of the flexible tarp may be used in the practice of the present invention.

It is evident from the above recitation of prior art patents that the use of flexible sheet materials for outdoor display and signboards is known, and that a variety of support structures and tensioning mechanisms has been proposed. None of the prior art systems, however, provides satisfactory and selective tensioning of the flexible sheet-like material in combination with a simplified and convenient assembly technique.

SUMMARY OF THE INVENTION

It is an objective of the present invention to provide a simplified tension mounting system and assembly wherein a flexible, sheet-like material may be suspended in a taut condition from a generally planar support surface and selectively tensioned by a plurality of bracket means which are fastenable to existing billboard structures, building support structures such as walls and roofs, and the like.

It is another objective of the present invention to provide a tension mounting system and assembly which facilitates installation and removal of flexible, sheet-like materials without requiring disassembly of mounting brackets.

It is still another objective of the present invention to provide clamping and selective tension adjustment of the flexible, sheet-like material by means of a single adjustment mechanism on each of a plurality of bracket means.

It is yet another objective of the present invention to provide a tension mounting system and assembly for suspending a flexible sheet material in a taut condition which is versatile and may be adapted to a variety of sign sizes, weights and designs.

It is yet another objective of the present invention to provide a simplified, compact tension mounting system and assembly which is suitable for suspending a flexible sheet material in a taut condition from a building wall, a trailer truck, a railroad car, or the like which does not interfere with required clearances of the support surface, and in which the mounting means are hidden from view.

The tension mounting assembly of the present invention comprises a flexible, sheet-like material with a retaining means extending around at least a portion of its peripheral edges, and a plurality of bracket means fastened to a generally planar support surface and arranged along at least two opposite edges of the flexible, sheet-like material, each bracket means adapted to clamp the retaining means and provide selective tensioning of the flexible sheet-like material by means of a single adjustment mechanism. The tension mounting system and assembly of the present invention is especially preferred for use in display signs and billboards for exhibiting and advertising message, but may also be used in any application where suspension of a flexible sheet material in a taut condition is desired.

BRIEF DESCRIPTION OF THE DRAWINGS

Further features of the present invention will be apparent from the following more detailed description of the invention read in conjunction with the drawings, wherein:

FIG. 6 shows a side view of the bracket means shown in FIG. 2 illustrating, in dashed lines, adjustment of the bracket arm during installation;

FIG. 9 shows a perspective side view of the rigid support means substantially as shown in FIG. 7 with flexible sheet material suspended therefrom;

FIGS. 29, 30, and 31 are sectional views illustrating the rotation and tension action of the cylindrical pipe and bracket of FIGS. 25 and 24;

FIG. 32 is a top view of the combined assembly using the first and second brackets.

DESCRIPTION OF PREFERRED EMBODIMENTS

Figure 1:
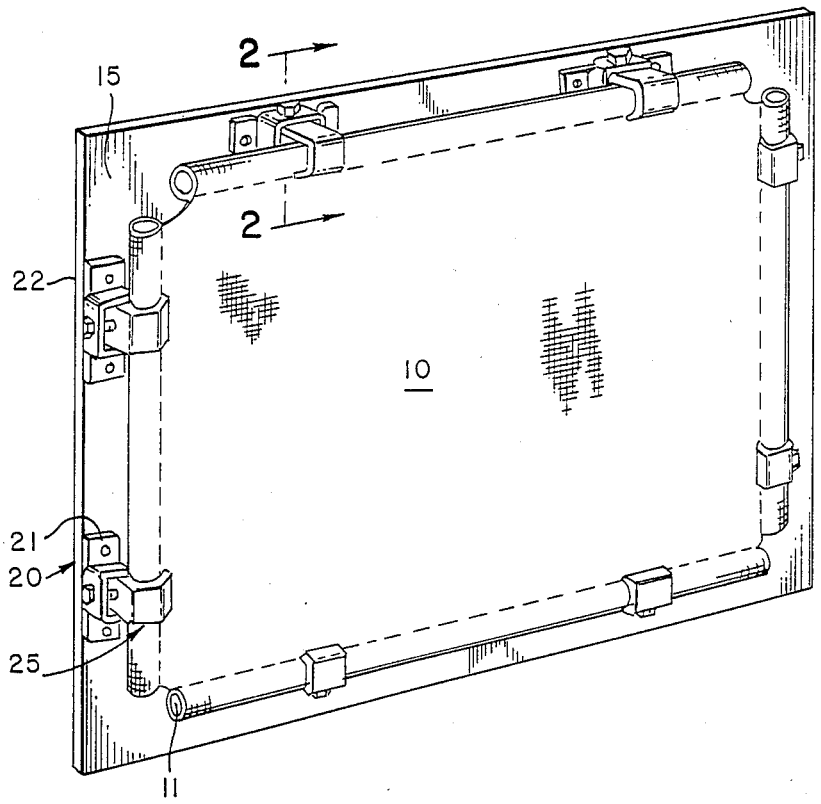
FIG. 1 shows a perspective view of the tension mounting assembly of the present invention.
Figure 3:
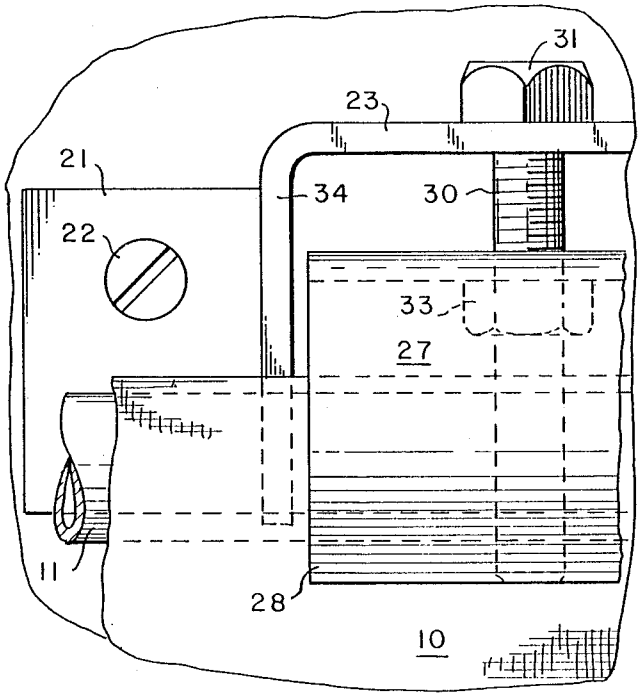
FIG. 3 shows an enlarged front view of the bracket means of FIG. 2.

As shown in FIG. 1, the tension mounting system and assembly of the present invention comprises flexible sheet material 10 provided with rigid retaining means 11 along its peripheral edges, and a plurality of bracket means 20 fastened to support surface 15 and spaced at intervals along at least two opposite peripheral edges of flexible sheet 10. Flexible sheet material 10 may comprise any flexible, fabric-like material and preferably comprises a sheet material reinforced to provide strength and durability. Synthetic materials and multilaminates which are weather-resistant are especially preferred, and suitable materials are well known in the art. Suitable means for applying an advertising message to the surface of flexible sheet 10, such as by painting, printing, silk screening, and the like, are also well known to the art.

At least a portion of the peripheral edges of flexible sheet 10 are mounted on rigid retaining means 11. According to the illustrated embodiments, a peripheral edge of flexible sheet material 10 forms a loop with the edge of flexible sheet 10 fastened to flexible sheet 10 at attachment point 12 by stitching, adhesives, or other fastening means known to the art. Rigid retaining means 11 are insertable in the loops thus formed at the peripheral edges of flexible sheet 10. Flexible sheet material 10 may be mounted on rigid retaining means 11 by other fastening means, such as adhesives, but the embodiment illustrated in the drawings is preferred for most applications.

Rigid retaining means 11 preferably comprise a lightweight metallic or rigid plastic material, and may be in the form of a tube or bar, or may have any cross-sectional configuration which is convenient for a particular application. Rigid retaining means 11 are preferably hollow, as shown, to reduce the weight of the assembly. Rigid retaining means 11 may be mounted at the peripheral edges of flexible sheet 10 at the assembly site to facilitate transport of the components to the site. Rigid retaining means 11 are preferably mounted at least at two opposite peripheral edges of flexible sheet 10 and are most preferably mounted along each peripheral edge of flexible sheet 10. Rigid retaining means 11 may be provided along the length of a peripheral edge, or rigid retaining means 11 may be provided in shorter lengths, and mounted at intervals along the peripheral edges of flexible sheet 10. Provision of a separate but continuous rigid retaining means 11 along the length of each peripheral edge of flexible sheet material 10 is preferred.

As shown in the perspective view of FIG. 1, a plurality of bracket means 20 are affixed to a generally planar support surface 15 for suspending flexible sheet 10 generally parallel to planar support surface 15, and for selectively tensioning flexible sheet 10. Each bracket means 20 preferably comprises at least two flanges 21 disposed on opposite sides of the bracket from one another for attachment to support surface 15. One or more bores are provided in each attachment flange 21 for receiving fasteners 22, and different types of fasteners 22 may be utilized, depending upon the composition of support surface 15. For example, support surface 15 may comprise all or a portion of an existing wooden surface 15 may be a building structure surface comprising wood, brick, cement, metal, or the like. Suitable fasteners 22 for attachment of bracket means 20 to support surface 15 are known to the art.

Bracket means 20 further comprises top wall 23 oriented in a plane substantially perpendicular to attachment flanges 21, and side walls 24 extending substantially perpendicular to top wall 23 and attachment flanges 21. Side walls 24 are preferably continuous with or rigidly fixed to attachment flanges 21 at one edge, while the opposite terminal edges 34 of side walls 24 form a clamp in combination with adjustable bracket arm 25. Top wall 23 is preferably continuous with or rigidly fixed to side walls 24. It is to be understood that the designation of top wall 23 does not necessarily indicate orientation of the wall with respect to the ground, since bracket means 20 may be mounted on support surface 15 in a variety of orientations and, for example, bracket means 20 mounted at opposite peripheral edges of flexible sheet 10 are mounted at an orientation rotated 180° from one another.

Figure 2:
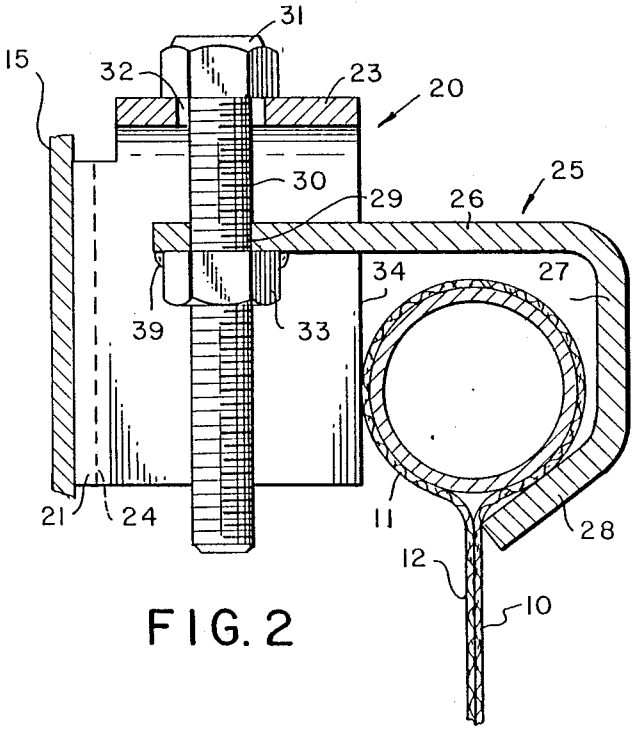
FIG. 2 shows an enlarged cross-sectional side view of the flexible sheet material suspended from a bracket means taken through line 2—2 of FIG. 1.

Threaded adjustment means 30 penetrates bore 32 in top wall 23, and also penetrates bore 29 in adjustable bracket arm 25. Bore 32 in top wall 23 is preferably located centrally with respect to side walls 24, and is preferably larger in diameter than threaded adjustment means 30 and smaller in diameter than head 31 at one terminal end of threaded adjustment means 30, as shown in FIG. 2. Threaded adjustment means 30 attached to adjustable bracket arm 25 is thus pivotable with respect to the central longitudinal axis of bore 32, as illustrated in FIG. 6, to facilitate insertion of rigid retaining means 11 in adjustable bracket arm 25.

Adjustable bracket arm 25 preferably comprises first leg 26 having bore 29 for receiving threaded adjustment means 30, first leg 26 extending beyond terminal edges 34 of side walls 24 and continuous with or rigidly fixed to side walls 24 and continuous with or rigidly fixed to second leg 27. Second leg 27 is preferably oriented generally perpendicular to first leg 26 and generally parallel to attachment flanges 21 and is continuous with or rigidly attached to first leg 26 and third leg 28. The inner surface of third leg 28 is preferably at an obtuse angle of from about 110° to about 135° with respect to the inner surface of second leg 27. Third leg 28 extends for less than the distance between terminal edges 34 of side walls 24 and second leg 27 to provide access for insertion and clamping of rigid retaining means 11 within adjustable bracket arm 25.

Nut 33 may be rigidly attached, such as by welds 39, to first leg 26 of adjustable bracket arm 25 and aligned with bore 29. Nut 33 is internally threaded to match the external threaded on threaded adjustment means 30, and threaded adjustment means 30 is thereby threadedly engageable on fixed nut 33. Alternatively, bore 29 in first leg 26 of adjustable bracket arm 25 may be provided with internal threads matching the external threads on threaded adjustment means 30 so that threaded adjustment means 30 is threadedly engageable in bore 29. As threaded adjustment means 30 is rotated in one direction, adjustable bracket arm 25 is axially displaced toward top wall 23 and, conversely, as threaded adjustment means 30 is rotated in the opposite direction, adjustable bracket arm 25 is axially displaced away from top wall 23.

When bore 32 in top wall 23 has a larger diameter than threaded adjustment means 30, threaded adjustment means 30 is pivotable with respect to the central longitudinal axis of bore 32, thereby enlarging the gap between the terminal end of third leg 28 and the terminal edges 34 of side walls 24, and permitting rigid retaining means 11 to be introduced into adjustable bracket arm 25. Threaded adjustment means 30 may then be rotated to axially displace adjustable bracket arm 25 toward top wall 23, thereby clamping rigid retaining means 11 between the inner surfaces of adjustable bracket arm 25 and terminal edges 34 of side walls 24. Additional rotation of threaded adjustment means 30 will result in axial displacement of adjustable bracket arm 25 and rigid retaining means 11 toward top wall 23, thereby tensioning flexible sheet 10.

Figure 5:
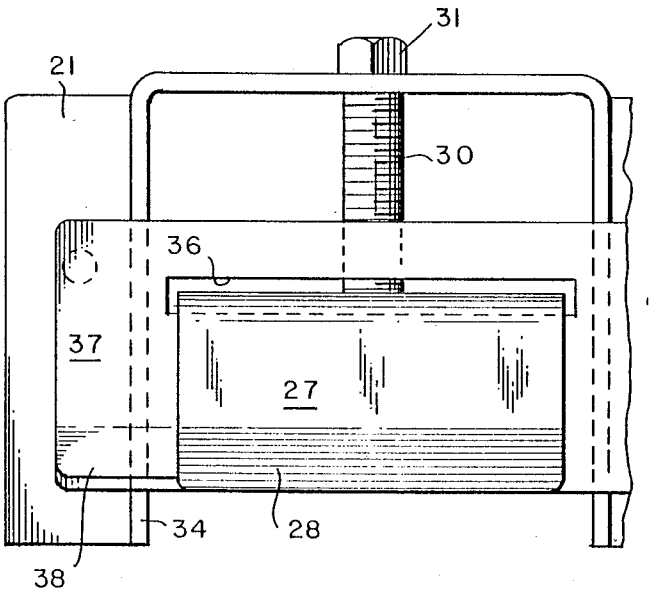
FIG. 5 shows a front view of the bracket means shown in FIG. 4.
Figure 4:
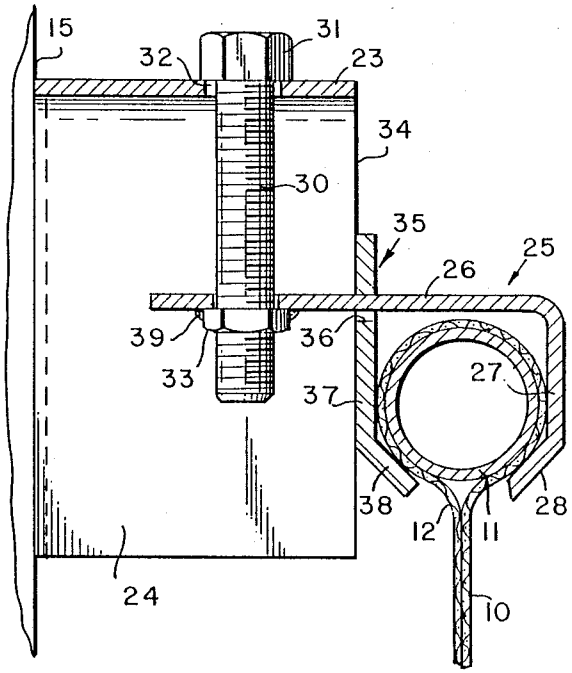
FIG. 4 shows an enlarged cross-sectional side view of another embodiment of a bracket means suitable for use in the tension mounting assembly of the present invention.

FIGS. 4 and 5 show another embodiment of bracket means 20 of the present invention. As shown in FIG. 4, bracket arm 25 may additionally comprise inner bracket arm 35 having first component 37 oriented substantially parallel to second leg 27 of adjustable bracket arm 25, and second component 38 provided at substantially the same angle with respect to first component 37 as third leg 28 is to second leg 27 of adjustable bracket arm 25. Inner bracket arm 35 may be rigidly attached to adjustable bracket arm 25, but is preferably adjustably mounted on adjustable bracket arm 25 by means of slot 36 receiving first leg 26 of adjustable bracket means 25, as shown in FIG. 4 and 5. Provision of slot 36 permits threaded adjustment means 30 to pivot with respect to the central longitudinal axis of bore 32, thereby enlarging the gap between the terminal ends of adjustable bracket arm 25 and inner bracket arm 35 and permitting rigid retaining means 11 to be inserted between adjustable bracket arm 25 and inner bracket arm 35. Rotation of threaded adjustment means 30 causes axial displacement of adjustable bracket arm 25, inner bracket arm 35 and threaded nut 33 along the central longitudinal axis of bore 32.

FIG. 5 illustrates a preferred embodiment of the bracket means shown in FIG. 4 wherein first component 37 and second component 38 of inner bracket arm 35 are wider than the corresponding walls of adjustable bracket arm 25 and top wall 23, and first component 37 of inner bracket arm 35 abuts terminal edges 34 of side walls 24. This embodiment of bracket means 20 prevents friction from occurring due to contact of flexible sheet 10 with terminal edges 34 of side walls 24, since flexible sheet 10 contacts only smooth, continuous surfaces of adjustable bracket arm 25 and inner bracket arm 35. Insertion of rigid retaining means 11 in bracket means 20, and tensioning of flexible sheet 10 may thus be achieved without causing rubbing or clamping friction at any point on flexible sheet 10.

The tension mounting system of the present invention operates as follows to provide suspension and selective tensioning of sheet material 10. Sheet material 10 is provided as desired with suitable advertising material, or the like, and is provided with suitable means for attachment of rigid retaining means 11 at a remote location and conveniently transported to the assembly site. Likewise, a plurality of rigid retaining means 11 and bracket means 20 may also be conveniently transported to the assembly site.

A plurality of bracket means 20 are provided for suspending and selectively tensioning flexible sheet material 10 at least at two opposite peripheral edges of flexible sheet material 10. For example, bracket means 20 may be provided only along the top and bottom peripheral edges of flexible sheet 10, or bracket means 20 may be provided only at the side peripheral edges of flexible sheet 10. For most applications and particularly those in which flexible sheet 10 comprises a relatively large surface area, bracket means 20 are preferably provided at intervals along each peripheral edge of flexible sheet 10. At least two bracket means 20 are preferably provided at each peripheral edge, and additional bracket means may be provided where the surface area and/or weight of flexible sheet 10 requires additional support.

Bracket means 20 are mounted on support surface 15 at appropriate intervals in accordance with the dimensions of flexible sheet 10. Rigid retaining means 11 may be mounted at the peripheral edges of flexible sheet 10 at the assembly site, and insertion of rigid retaining means 11 into adjustable bracket arm 25 of each bracket means 20 may be achieved by sequentially pivoting each adjustable bracket arm 25 and rotating threaded adjustment means 30 to axially displace adjustable bracket arm 25 sufficiently to clamp rigid retaining means 11 between the inner surfaces of adjustable bracket arm 25 and terminal edges 34 of side walls 24 of bracket means 20. Rigid retaining means 11 may be sequentially clamped within the adjustable bracket arm of each bracket means 20 in this fashion. Flexible sheet 10 is then suspended, and selective tensioning may be provided by further rotation of threaded adjustment means 30 at appropriate bracket means 20, as necessary, to provide flexible sheet 10 in a taut and wrinkle-free condition.

Figure 8:
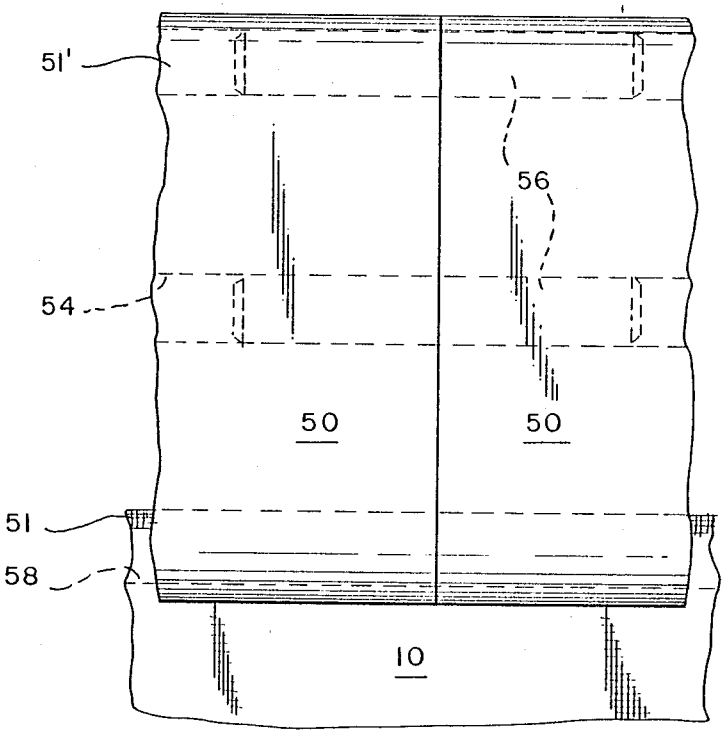
FIG. 8 shows a front view of the tension mounting assembly illustrated in FIG. 7 with two rigid support means joined together.
Figure 7:
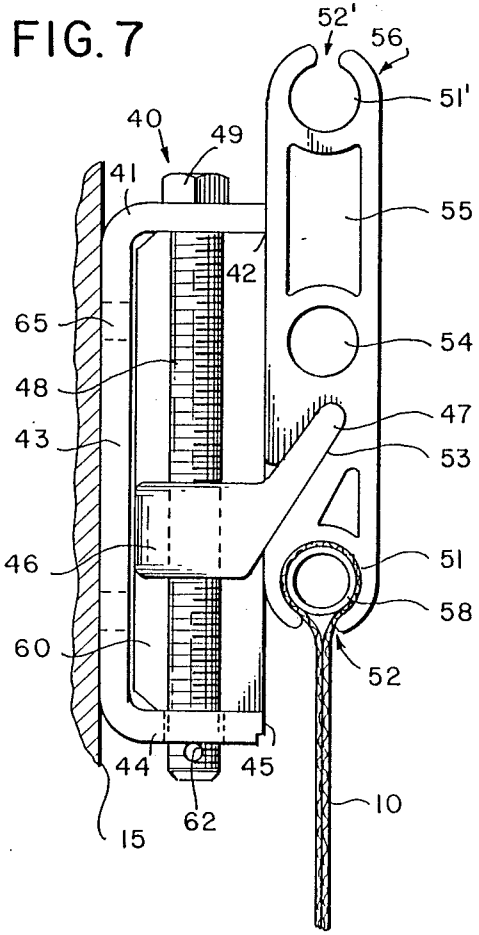
FIG. 7 shows a side view of another embodiment of the tension mounting assembly of the present invention.

FIGS. 7–9 illustrate another embodiment of the tension mounting assembly of the present invention. As in the previously described embodiments of the tension mounting assembly, rotation of a threaded adjustment means induces axial displacement of the means supporting the flexible sheet material to provide suspension and selective tensioning of the flexible sheet material. This embodiment provides a compact tension mounting assembly which is suitable for suspending a flexible sheet material in a taut condition from a building wall, trailer truck, railroad car, or the like, which does not interfere with required clearances for the support surfaces, and in which the support means and/or the bracket means may be hidden from view.

As shown in FIG. 7, the tension mounting assembly comprises bracket means 40 and rigid support means 50 in addition to flexible sheet 10 and enlarged retaining means 58 mounted at least at one peripheral edge of flexible sheet 10. Enlarged retaining means 58 may comprise a variety of rigid or semi-rigid materials, such as rigid metallic or plastic tubing, rope, cable, bars, or any material which is not altered in configuration as a result of forces exerted on it against a rigid structure. Enlarged retaining means 58 must be capable of remaining substantially unchanged in configuration when sheet material 10 is suspended under high tension forces.

Enlarged retaining means 58 are mounted along the peripheral edges of flexible sheet 10. According to the illustrated embodiment, a peripheral edge of flexible sheet material 10 forms a loop in which enlarged retaining means 58 is insertable. Other suitable means of supporting enlarged retaining means 58 are known to the art. At least one enlarged retaining means 58 is mounted along at least one peripheral edge of flexible sheet 10, and, according to an especially preferred embodiment, enlarged retaining means 58 are provided continuously along all peripheral edges of flexible sheet 10.

Bracket means 40 comprises a rigid, generally C-shaped bracket having first leg 41 rigidly attached and oriented generally perpendicularly with respect to second leg 43, which is rigidly attached and oriented generally perpendicularly with respect to third leg 44. First leg 41 and third leg 44 are thus oriented substantially parallel to one another, and terminal edge 42 of first leg 41 is preferably generally aligned with terminal edge 45 of third leg 44. Second leg 43 is provided with attachment means, such as bores 65 and suitable fasteners, or other attachment means which are known to the art and which are capable of securely fastening second leg 43 of bracket means 40 to support surface 15. First leg 41 and third leg 44 are provided with aligned bores for receiving threaded adjustment means 48. The bores are preferably generally centrally arranged in first leg 41 and third leg 44, are not threaded, and are sized to accommodate and retain threaded adjustment means 48 in a rotatable but stationary condition with respect to the central longitudinal axis of threaded adjustment means 48. Enlarged head 49 of threaded adjustment means 48 retains threaded adjustment means 48 on bracket means 40, and retainer 62, such as a pin, cotter pin, or the like, preferably provided at the opposite end of threaded adjustment means 48 to retain threaded adjustment means 48 in an axially immovable condition on bracket means 40.

Adjustable arm means 46 may be internally threaded and thus directly engageable on threaded adjustment means 48, as shown in FIG. 7, or adjustable arm means 46 may be rigidly attached to an internally threaded nut, as previously described with reference to adjustable bracket arm 25 and shown in FIGS. 2–6. Adjustable arm means 46 is threadedly engaged on threaded adjustment means 48 between first leg 41 and third leg 44 of bracket means 40. Internally threaded adjustable arm means 46 is provided with angled projection 47 which extends beyond terminal edges 42 and 45 of first leg 41 and third leg 44, respectively, and is oriented at an obtuse angle with respect to first leg 41 and third leg 44.

According to a preferred embodiment of the present invention, channel-shaped reinforcement means 60 is mounted to the inner surfaces of bracket means 40. Reinforcement means 60 preferably comprises two parallel walls having generally rectangular surfaces defined by the inner surfaces of legs 41, 43 and 44 of bracket means 40 and terminal edges 42 and 45 of first and third legs 41 and 44, respectively. The two parallel walls of channel-shaped reinforcement means 60 extend parallel to threaded adjustment means 48, are provided adjacent adjustable arm means 46, and are joined by a perpendicular wall extending parallel to and abutting second leg 43 of bracket means 40. Reinforcement means 60 may be secured to bracket means 40 by a variety of means which are known to the art, or reinforcement means 60 may be provided with attachment bores aligned with bores 65 in second leg 43 for attachment of bracket means 40 to support surface 15. Reinforcement means 60 serves to reinforce bracket means 40, particularly at first leg 41 and third leg 44, prevents adjustable arm means 46 from rotating on threaded adjustment means 48, and facilitates alignment of support means 50 parallel to support surface 15. Reinforcement means 60 may alternatively be provided as generally rectangular plates or walls adjacent adjustable arm means 46 and having a surface area defined by the inner surfaces of legs 41, 43 and 44 of bracket means 40 and terminal edges 42 and 45 of first and third legs 41 and 44, respectively.

Rigid support means 50 preferably comprises a separate component having at least one continuous bore 51 accommodating enlarged retaining means 58 and a continuous access opening 52 adjacent continuous bore 51, and preferably extending along a central portion of a first longitudinal edge. As shown in FIG. 7, continuous bore 51 is sized to accommodate enlarged retaining means 58 mounted at a peripheral edge of flexible sheet 10 and access opening 52 is sized to accommodate passage of flexible sheet 10. Rigid support means 50 may additionally comprise a second continuous bore 51' capable of retaining enlarged retaining means 58 and a second continuous access opening 52' adjacent continuous bore 51' and preferably extending along a central portion of a second longitudinal edge. According to this embodiment, enlarged retaining means 58 mounted at a peripheral edge of flexible sheet 10 may be suspended from a second longitudinal edge of rigid support means 50, shown as the upper edge in FIG. 9, whereby flexible sheet 10 conceals rigid support means 40 from view, as well as from a first longitudinal edge, shown as the lower edge in FIGS. 7 and 8, whereby rigid support means 50 provides a visible framework around flexible sheet 10. A double-sided display may also be provided according to this embodiment, with a first flexible sheet suspended from one continuous bore, and a second flexible sheet suspended from the other continuous bore.

Rigid support means 50 additionally comprises a continuous angled groove 53 having a configuration and dimension designed to accommodate angled projection 47 extending from internally threaded adjustable arm means 46. Projection 47 is engageable in and slideable along continuous angled groove 53. Continuous groove 53 is provided in a lower portion of rigid support means 50 to provide a tension mounting assembly wherein bracket means 40 are hidden from view. The height of rigid support means 50 between the upper and lower longitudinal edges preferably corresponds at least to the distance between first leg 41 and third leg 44 of bracket means 40. In this way, bracket means 40 and threaded adjustment means 48 are not visible to a person viewing advertising material provided on flexible sheet 10.

Rigid support means 50 preferably comprises a rigid metallic or synthetic plastic material which may be machined, formed, or extruded to provide the necessary bores, grooves, and the like. The outwardly facing surface of rigid support means 50 may be smooth as shown, or it may be ribbed to provide a decorative framework for flexible sheet 10. Rigid support means 50 may be provided with one or more cutout portions 55 to reduce the weight of the support means. Rigid support means 50 may be aligned and assembled using one or more splice pins 56 insertable in one or more bores 54, 51, to join a plurality of rigid support means consecutively, forming a continuous support means framework.

Assembly and disassembly of the tension mounting assembly shown in FIG. 7–9 proceeds in generally the same fashion as described above with reference to the embodiments illustrated in FIGS. 1–6. Bracket means 40 may be fastened to support surface 15 at locations corresponding to the peripheral edges of flexible sheet 10 bearing enlarged retaining means 58. Bracket means 40 are mounted on support surface 15 at appropriate intervals in accordance with the dimensions of flexible sheet 10, and the rigid support means, with at least one bracket means provided to mount each rigid support means. Bracket means 40 mounted on opposite peripheral edges of flexible sheet 10 are rotated 180° with respect to one another so that angled projections 47 of the center of adjustable arm means 46 extend away from the center of flexible sheet 10 to provide suitable tensioning means. Enlarged retaining means 58 may be mounted at the peripheral edges of flexible sheet 10 at the assembly site, if desired, and flexible sheet 10 may then be mounted on rigid support means 50 by sliding enlarged retaining means 58 in continuous bore 51 or 51' of rigid support means 50. Rigid support means 50 are provided in lengths substantially greater than the length of bracket means 40, and a plurality of rigid support means 50 may be aligned and joined along each peripheral edge of flexible sheet 10, as described previously. Enlarged retaining means 58 and bracket means 40 are provided at least at two opposite peripheral edges of flexible sheet 10 to provide suspension and selective tensioning of the flexible sheet material. It is possible to provide bracket means 40 along a single peripheral edge of flexible sheet 10 and to fixedly attach the opposite edge of flexible sheet 10 to the support surface, thus providing adjustable tensioning along only one peripheral edge of flexible sheet 10. It is preferred, for most applications, to provide bracket means at intervals along each peripheral edge of flexible sheet 10.

Continuous angled grooves 53 of rigid support means 50 are mounted on angled projections 47 of adjustable arm means 46 by means of appropriate adjustment of adjustable arm means 46, and flexible sheet 10 is thus suspended from support surface 15. Rotation of threaded adjustment means 48 axially displaces adjustable arm means 46 and rigid support means 50 with respect to bracket means 40. Selective tensioning may be provided by further rotation of threaded adjustment means 48 at appropriate bracket means 40 as necessary, to provide flexible sheet 10 in a taut and wrinkle-free condition.

The embodiment of the tension mounting system and assembly shown in FIGS. 7 and 8 is particularly suitable for applications where a continuous border around the material displayed on flexible sheet 10 is desired, and where a compact tension mounting assembly capable of suspending a flexible sheet at a short distance from a support surface is desired. This embodiment is particularly suitable for use on trailer trucks, railroad cars, and the like, where required clearances are of importance. According to the embodiment illustrated in FIG. 9, both the bracket means and the rigid support means are hidden from view, and only flexible sheet 10 is visible to the viewer.

Assembly and disassembly of the tension mounting system of the present invention may be achieved in a very short period of time. Assembly and disassembly of this tension mounting system does not require any specialized tools or skills, and suspension and removal of flexible sheets 10 may be achieved without disassembling the mounting brackets. The tension mounting system of the present invention is suitable for outdoor and indoor use. Decorative border and/or corner finishing pieces may be provided as desired to enhance the aesthetic appearance of the tension mounting assembly. The flexible sheet may be illuminated from behind by lights mounted on the support surface, since the configuration and dimensions of the bracket means may be varied to suspend the flexible sheet at any predetermined distance from the support surface.

Figure 10:
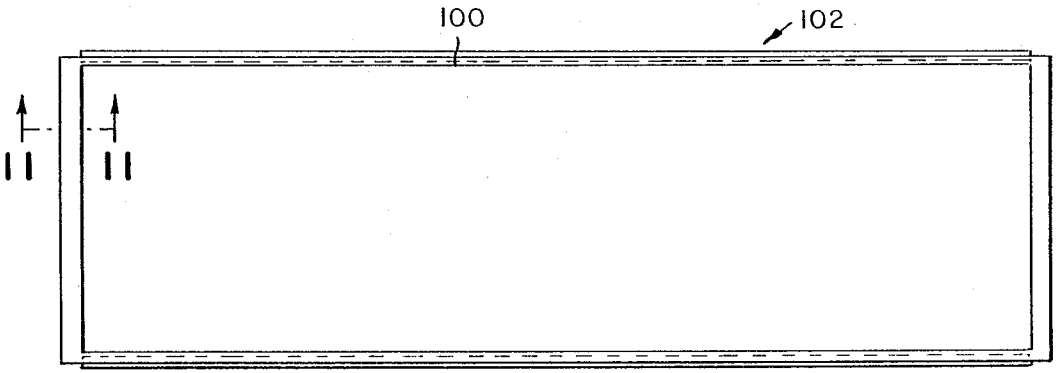
FIG. 10 is a plan view of another embodiment of the tension mounting assembly of the present invention.

Referring now to FIGS. 10–14, a third embodiment of the tension mounting assembly of the invention will be described. Referring first to FIG. 10, the tension mounting assembly according to this third embodiment essentially comprises a frame-type structure 100 which is connected about the periphery of a planar support surface such as a billboard 102. As in the previous embodiments, the mounting assembly of the embodiments of FIGS. 10–14 is designed for suspending a flexible sheet material in a taut condition. The flexible sheet has an enlarged retaining member connected with the peripheral edges thereof, the retaining member being mounted in the frame of the tension mounting assembly as will be set forth in greater detail below.

Figure 11:
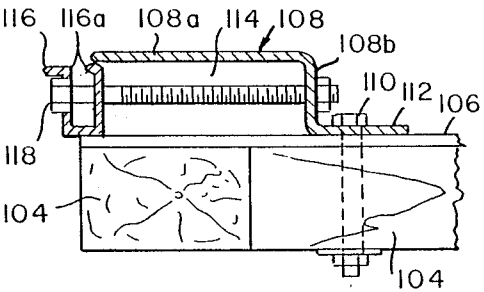
FIG. 11 is a sectional view taken along lines 11—11 of FIG. 10.

Referring now in FIG. 11, one form of the tension mounting assembly of the third embodiment will be described. The billboard 102 comprises a peripheral frame including studs 104 and generally planar facing members such as sheets of plywood 106. A bracket 108 is connected with a billboard stud 104 by a mounting bolt 110 which passes through a flange 112 of the bracket 108. The bracket includes a first portion **108*a* which is arranged in spaced parallel relation to the plywood facing 106 of the billboard to define a recess 114 open at one end. The closed end of the recess defined by a perpendicular wall 108*b* of the bracket contains a threaded opening for a purpose to be described in greater detail below. A jaw member 116, which has a generally U-shaped cross-sectional configuration, is adapted for slideable movement within the bracket recess 114. The open end of the jaw recess is arranged normal to the open end of the bracket recess as shown in FIG. 11. That is, as shown in this figure, the bracket recess extends to the left edge of the bracket whereas the jaw recess extends upwardly. The jaw member 116 contains a pair of aligned openings which are aligned with the threaded opening in the bracket member 108. A threaded bolt 118 is arranged within the aligned openings in the jaw member 116 and the bracket 108. When the bolt is rotated, the threaded connection between the bolt and the opening in the bracket serves to displace the bolt and thus the jaw member 116 relative to the bracket recess 114**.

Figure 14:
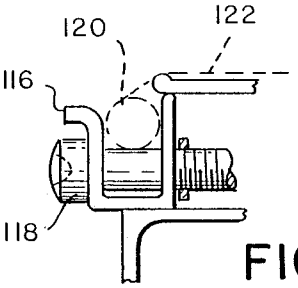
FIGS. 14 and 15 are partial detailed views of the jaw of the embodiment of FIGS. 11–13 in its open and closed positions, respectively.
Figure 15:
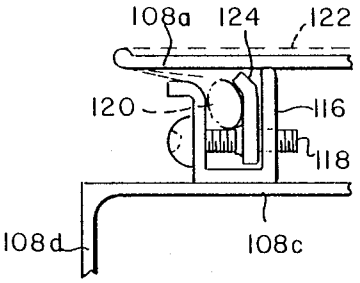

Referring now to FIGS. 14, 15, the jaw 116 is adapted to receive the enlarged retaining member 120 connected with the peripheral edge of the fabric sheet 122. Thus when the bolt 118 is rotated to displace the jaw member inwardly into the recessed 114 of the bracket, the retaining member 120 of the fabric sheet is also displaced inwardly and the first portion 108 of the bracket closes the open end of the jaw member as shown in FIG. 15. Continued inward movement of the jaw member serves to pull the fabric sheet in a taut condition as the retaining member 120 moves inwardly, thereby drawing the sheet of fabric about the end of the bracket first portion 108 as shown in FIG. 15. When a plurality of brackets are arranged about the peripheral edge of the billboard, the bolts of each bracket are adjusted to pull the edges of the fabric sheet taut.

The retaining member 120 connected with the peripheral edge of the sheet of fabric 122 preferably comprises a piece of hem rope which may be compressed within the jaw member 116 as shown in FIG. 15. More particularly, the jaw member includes a clasp 124 which is threadably connected with the bolt 118, whereby as the bolt is rotated, the clasp is drawn against the rope retaining member 120 to clasp the retaining member within the jaw member as shown. In order to retain the rope retaining member within the jaw member when it is in its open position as shown in FIG. 11, the jaw member may also contain projection portions **116*a*** adjacent the upper ends of the jaw recess.

Figure 12:
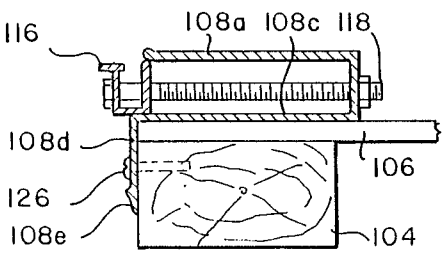
Figure 18:
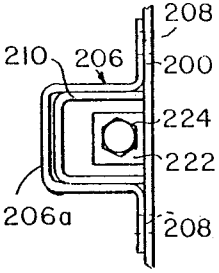
FIGS. 17–19 are left side, right side, and front plan views respectively of the embodiment of FIG. 16.

An alternate configuration of the bracket 108 is shown in FIG. 12. In this configuration, the bracket includes a first portion **108*a* spaced from the planar support surface billboard and a second portion 108*c* which is in contiguous relation with the support surface, the first and second portions being integrally connected via the end wall 108***b*. The bracket recess 114 is thus defined between the first and second portions 108*a*, 108*c* of the bracket. The bracket also contains a third portion 108*d* which is connected with the end of the second portion 108*c* and is arranged normal thereto as shown in FIG. 12. This bracket third portion rests against the side edge of the billboard and preferably extends beyond the billboard planar plywood sheet 106 to a length commensurate with the thickness of a stud 104 of the billboard. The bracket 108 of the embodiment of FIG. 12 thus wraps around the corner of the billboard. A suitable fastener such as a nail or screw 126 passes through an opening in the bracket third portion 108*d* and into the stud 104 for securely mounting the bracket onto the billboard frame.

Figure 13:
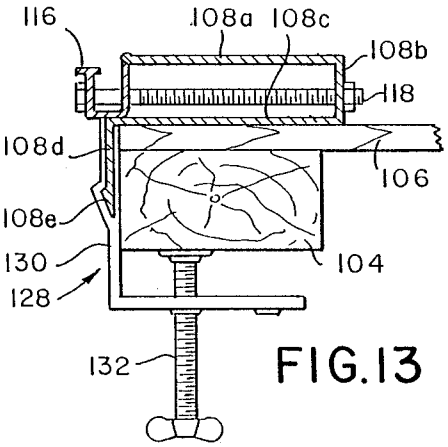
FIGS. 12 and 13 are sectional views illustrating modifications to the embodiment of FIG. 11.

In the modification of FIG. 13, the bracket 108 is similar to that shown in FIG. 12 and a clamping mechanism 128 is provided to clamp the bracket 108 to the billboard frame. This clamping mechanism includes an L-shaped member 130 containing a recess for receiving the third portion 108*d* of the bracket. As shown in FIG. 13, this recess contains a notch for receiving a spar 108*e* on the end of the bracket third portion 108*d*. Thus, once the bracket third portion is inserted into the recess in the L-shaped member 130 of the clamp, the bracket cannot be removed therefrom without separating the recess defining portions of the upper leg of the member 130. A threaded bolt 132 passes through a threaded opening contained in the bottom leg of the L-shaped member 30. As the bolt is rotated, it is tightened against the stud 104 of the billboard to draw the L-shaped member 130 and the bracket 108 against a front planar surface of the billboard. Additional bolts 132 may be provided to increase the strength of the bracket mounting assembly shown in FIG. 13.

With the embodiment of FIGS. 10–15, the brackets may be permanently mounted about the periphery of the billboard to define the frame 100 which is secured to the billboard and remains in place thereon. Accordingly, the brackets may be elongated, and the jaws 116 may also be elongated to receive the rope-type retainer 120 mounted along the peripheral edge of the fabric sheet. A plurality of openings may be provided in the jaw member 116 and bracket 108 along each side edge of the billboard frame to provide an even tightening mechanism about the periphery of the frame. With such an assembly, a preconstructed fabric sign with an edge retainer rope can easily be installed by a worker with only a wrench being necessary to tighten the adjustment bolts. With the brackets in their loose position (i.e. with the jaw members open as shown in FIG. 14), the worker inserts the retaining rope of the fabric sign into the jaws of the frame. The worker next pulls the sign taut by successively tightening the various adjustment bolts 118 of the bracket members about the billboard. It is preferable to initially tighten the bracket members on the sides of the longest dimension, with the brackets on either end being worked alternatively to incrementally tighten the sheet of fabric along that dimension. Then, the brackets along the other edges of the billboard are tightened opposite each other to evenly draw the sheet of fabric material across the surface of the billboard.

Figure 22:
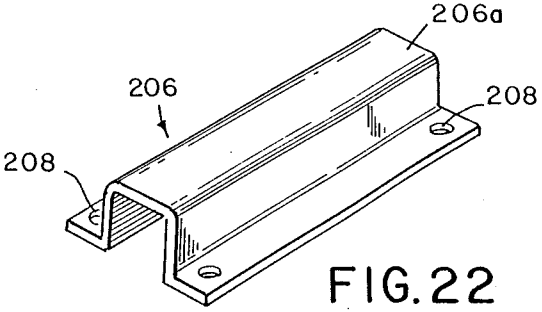

A fourth embodiment of a tension mounting assembly for suspending flexible sheet material in a taut condition across a generally planar support surface is shown in FIGS. 16–23. In this embodiment, a generally planar base 200 is connected with the planar support surface, such as the plywood sheathing of a billboard, adjacent at least one edge thereof. The base includes a raised block portion 202 which contains a threaded opening 204 the axis of which extends parallel to and spaced from the plane containing the base 200. A cover member 206 is shown in FIG. 22 and is adapted for connection with the base 200. Suitable fastening members, not shown, pass through aligned openings 208 contained in the cover member and the base for connecting the cover member and base with the planar support surface. The cover includes an elongated raised portion 206*a* which defines a channel between the cover and the base.

Figure 23:
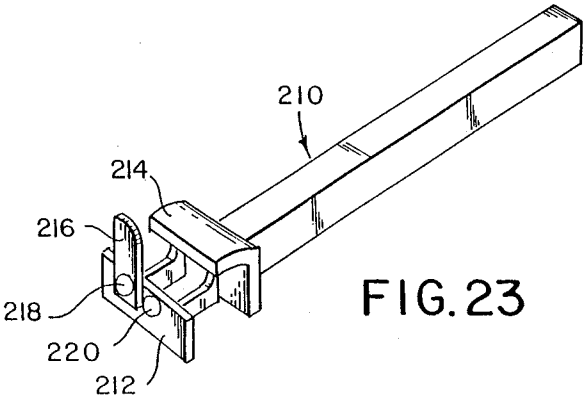

Referring now to FIG. 23, there is shown a jack member which is adapted for arrangement within the channel defined between the cover 206 and base 200. The jack member contains a channel in its bottom surface and thus is adapted to slide over the raised block 202 mounted on the base 200 for longitudinal displacement within the channel. As shown in FIGS. 22 and 23, the configuration of the elongated jack member corresponds with the configuration of the cover member raised portion 206*a* so that the cover member guides the jack member 210 during displacement of the jack member within the channel. At one end of the jack member there is provided an end plate 212 and an upper lip portion 214 which define a recess for a purpose as will be developed with reference to FIGS. 16–20. Also connected with the end plate 212 is a locking plate 216 which is rotatable about a pin or bolt 218 for rotation relative to the end plate 212. The end plate 212 also contains an opening 220 which is aligned with the threaded opening 204 in the raised portion 202 of the base 200.

Figure 16:
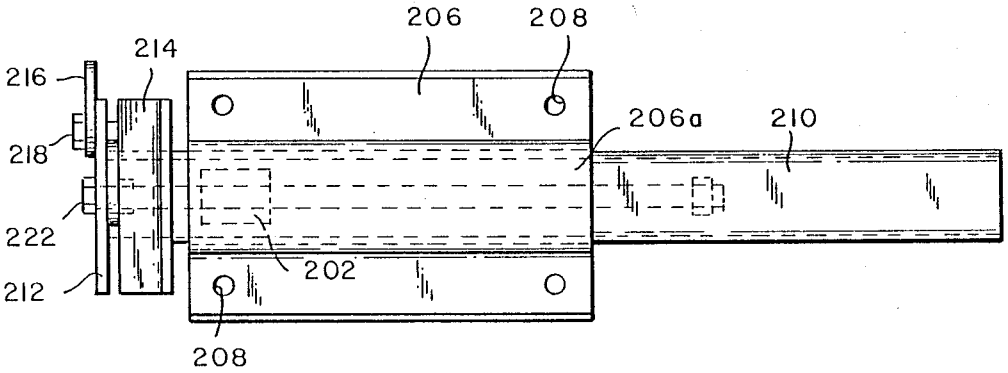
FIG. 16 is a top plan view of a further embodiment of the tension mounting assembly of the present invention.
Figure 17:
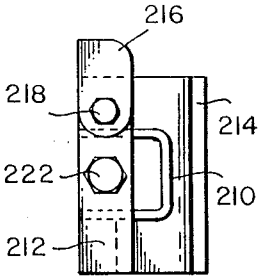
Figure 19:
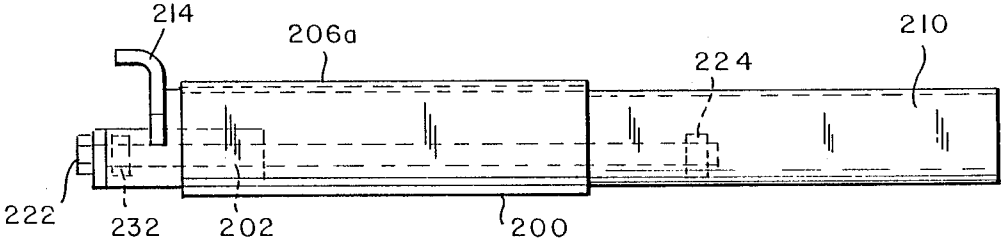

Referring now to FIGS. 16–20, the assembled cover 206, base 200 and jack member 210 are shown. The jack member has a length roughly twice that of the length of the base and cover members. A threaded bolt 222 is arranged within the opening 220 in the jack member end plate 212 and is threaded through the threaded opening 204 contained in the raised block 202 of the base as shown in FIGS. 16 and 19. The threaded bolt is operable upon rotation to displace the jack member longitudinally within the channel defined by the cover member 206. A lock nut 224 is connected with the end of the bolt 222 to prevent the bolt from being completely withdrawn from the opening 204 of the base raised block 202.

Figure 20:
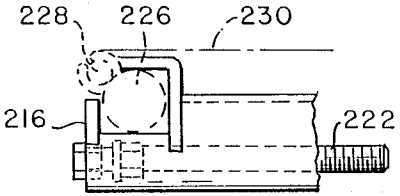
FIG. 20 is a partial detailed front view of the assembly of FIGS. 16–19 with a sheet retaining fixture in its operative position.
Figure 21:
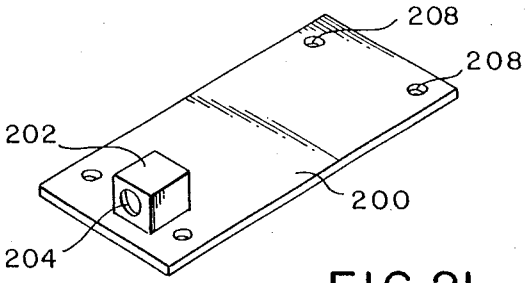
FIGS. 21–23 are perspective views of the base, cover, and jack member, respectively of the embodiments of FIGS. 16–20.

As shown FIG. 20, the end plate 212 and the upper lip 214 of the jack member 210 define a recess for receiving an extrusion type fixture 226 which is provided with a groove for receiving the rope-type retaining member 228 connected with a peripheral edge of the sheet of fabric material 230. With the fixture 226 arranged in the recess between the end plate 212 and the upper lip portion 214 of the jack member, the locking plate 216 is rotated to an upward position as shown in FIGS. 20 and 23 to close the recess and retain the fixture 226 therein. The recess is shown in its open position in FIG. 19 for receiving the fixture. That is, in FIG. 19, the locking plate is in its lower open position where it is arranged parallel with the end plate 212. With the fixture secured in the recess between the end plate and the upper lip portion of the jack member, the threaded bolt 222 can be rotated, whereby the bolt is displaced relative to the base and cover members. Behind the end plate is a threaded member 232 which is operable to displace the end plate and thus the entire jack member 210 upon rotation of the bolt 222.

When the jack member is arranged completely within the cover channel, the fixture having the retainer of the sheet of fabric is inserted into the recess and the locking plate is pivoted toward its closed position to retain the fixture within the recess. The bolt 222 is then rotated to draw the jack member 210 out of the cover channel (i.e. in the left direction with reference to FIGS. 16 and 19) in order to tighten the sheet of fabric since the fixture 226 is also drawn away from the center thereof.

A plurality of jacks are arranged around the periphery of the billboard in order to tension a sheet of fabric material across the billboard in a manner similar to that described above with reference to FIGS. 10–15. That is, the jacks on the opposite sides of the billboard are displaced outwardly by rotation of the tension bolts 222 in order to displace each edge of the sheet of fabric toward a taut position. The jacks at opposite edges of the billboard are alternately operated to progressively stretch the sheet of fabric across the face of the billboard. Typically, a billboard is 48 feet in width and on the order of 14 feet in height. It is desirable to initially stretch the longer width dimension first and then stretch the shorter height dimension of the fabric to obtain a uniform taut condition thereof. A typical sheet of fabric has on the order of a 3% stretch factor. Thus with a 48 foot width sheet of fabric, a stretch of the fabric on the order of 18 inches is possible. For such a fabric dimension, the jacks are designed to provide a 9 inch displacement relative to each base thereof, whereby two jacks operating in concert on opposite ends of the billboard will provide a total stretching of the fabric of the required 18 inches for a standard billboard size. Of course, for smaller billboards, smaller jack assemblies may be provided. Similarly, larger jacks may be provided for larger size billboards or for stretching large size pieces of fabric.

There is shown in FIGS. 24–33 a fifth embodiment of the tensioning assembly according to the present invention. This embodiment incorporates certain elements of the tension system shown in FIGS. 7–9.

Figure 33:
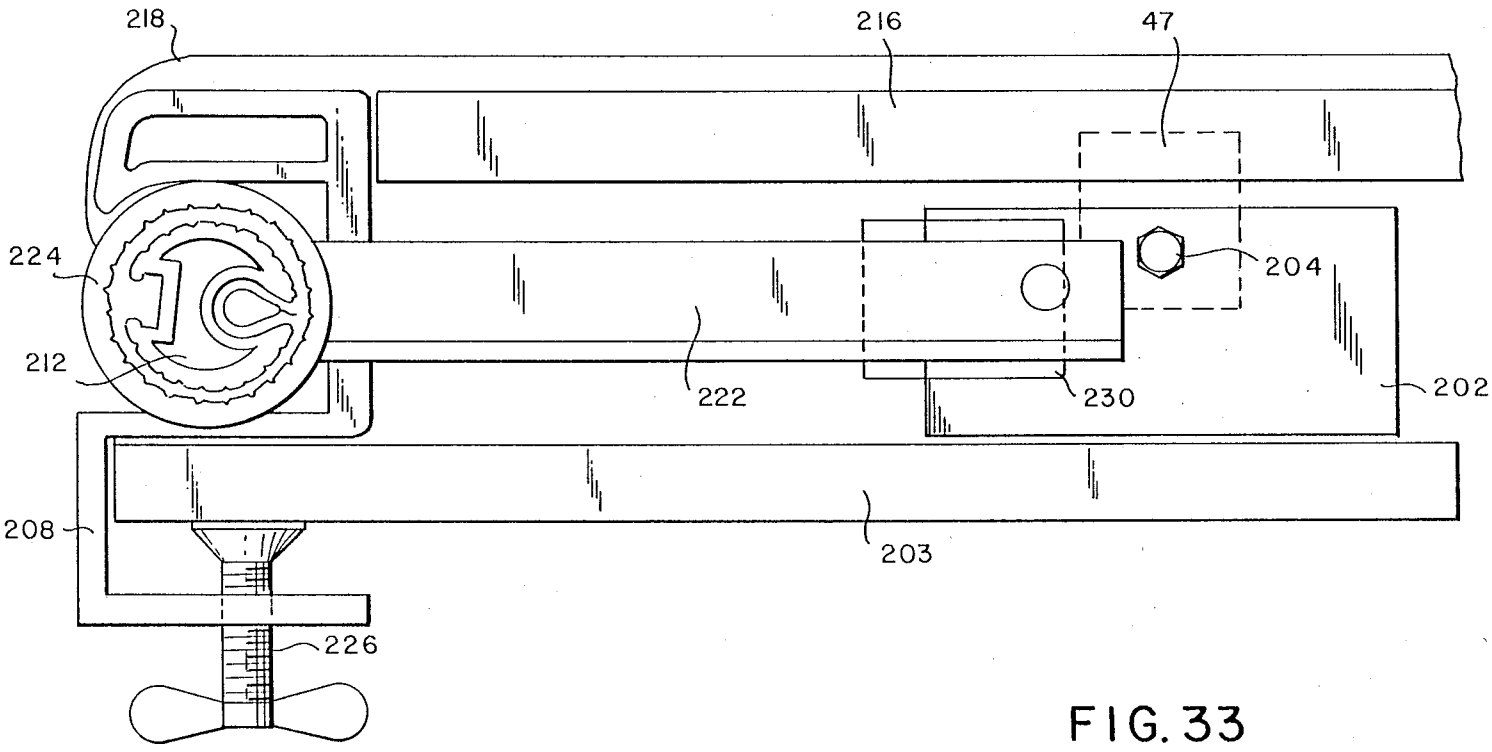
FIG. 33 is a side view of an alternate construction of the combined assembly of FIG. 32.

As shown in FIGS. 32 and 33, a C-shaped bracket 202 is provided which is connected with a longitudinal edge of the planar face 203 of a billboard assembly. Preferably a plurality of C-shaped brackets 202 are connected with the side edge of the billboard which corresponds with the longer width dimension of the fabric sheet which is to be mounted thereon. A threaded bolt 204 is connected with each of the C-shaped brackets in the manner described above and shown in FIG. 7. An adjustable arm 47 is threadedly engaged on the adjustment bolt 204 for displacement relative to the C-shaped bracket 202. Rigid support means 206 include engagement means for engaging the adjustable arm means, whereby upon rotation of the threaded bolt, the adjustable arm is axially displaced to displace the rigid support means as described above with reference to FIGS. 7–9. At the edge of the fabric sheet (FIG. 26) is the rigid retainer element 216. This rigid retainer element is engaged by the rigid support means 206 so that upon displacement of the rigid support means, the edges of the fabric sheet are pulled taut. Thus, with the C-shaped brackets arranged along the top and bottom edges of the generally rectangular billboard, the threaded bolts 204 in each of the C-shaped brackets 202 are operated to displace the rigid supports 206 along the upper and lower edges of the billboard to stretch the fabric sheet along its height.

Figures 24, 25, 26:
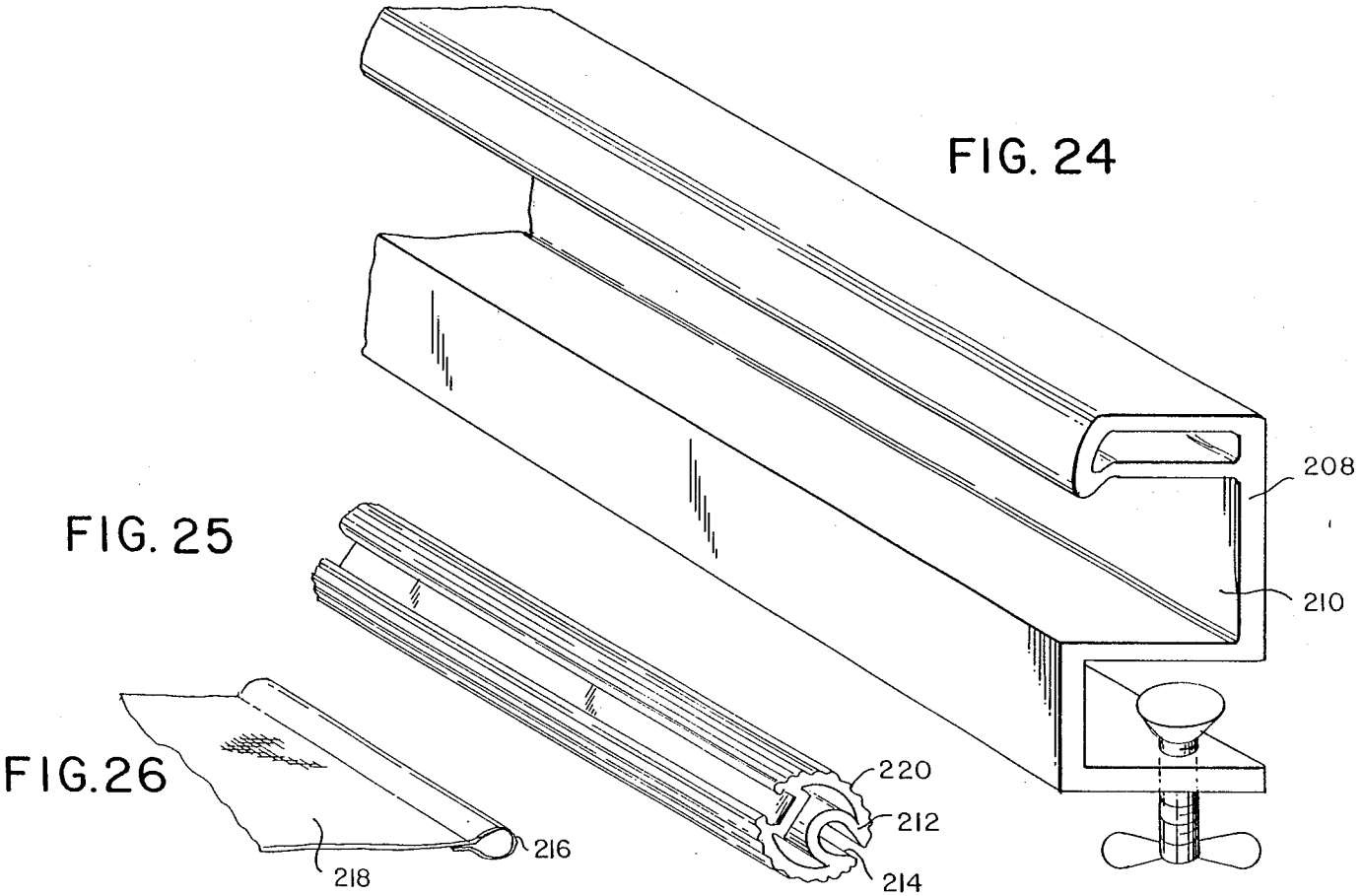
FIGS. 24–26 are perspectively views of a second bracket, cylindrical pipe, and fabric material with a rigid retainer element at one edge thereof, respectively of another embodiment of a tension assembly according to the invention.
Figure 27:
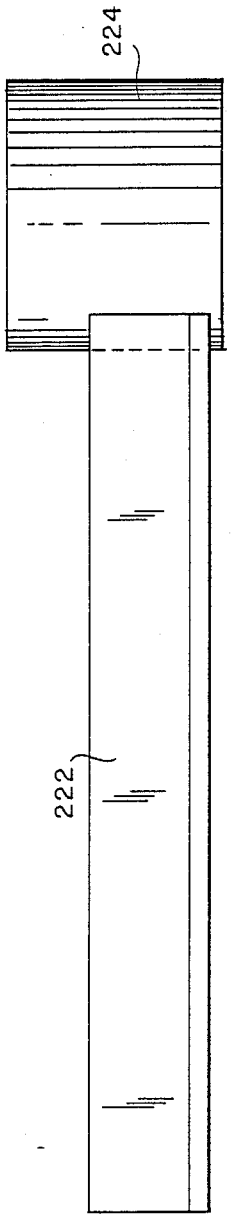
FIGS. 27 and 28 are side and top views, respectively, of a handle for the pipe of FIG. 25.
Figure 28:
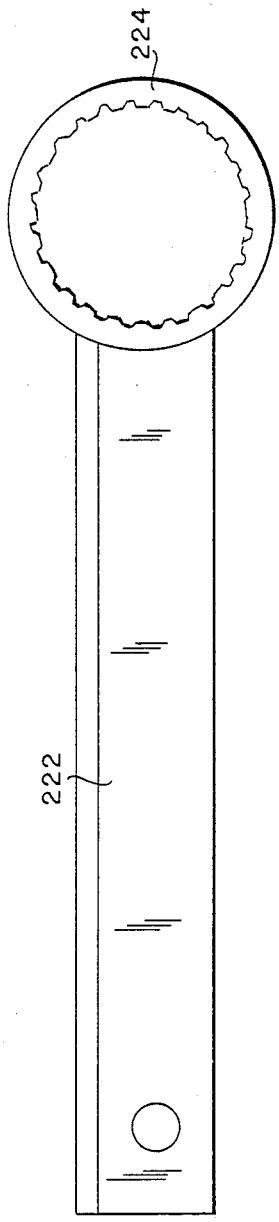

Referring now more particularly to FIGS. 24, 25 and 33, the modification of the fifth embodiment according to the invention will be described. A second bracket member 208 is connected with the planar surface of the billboard along an edge thereof. More particularly, a plurality of second brackets 208 are connected with the side edges of the billboard in order to stretch the sheet of fabric material across its width. Each second bracket contains a recess 210 adjacent the front planar surface of the billboard. Arranged within the recess is a generally cylindrical fixture or pipe 212 which is elongated along the side edge of the billboard and thus extends through a plurality of brackets mounted at each side of the billboard. As shown in FIGS. 25 and 26, the elongated cylindrical fixture contains a longitudinal channel 214 for receiving the enlarged retaining member 216 connected with the side edge of the sheet of fabric material 218. The outer surface of the elongated fixture or pipe has a toothed configuration at one end thereof as shown at 220. A separate handle or crank 222 (FIGS. 27 and 28) is provided for rotating the fixture or pipe 212 within the recess 210 of the bracket 208. More particularly one end 224 of the crank or handle 222 is splined and contains an inner toothed configuration 224 corresponding with the toothed configuration 220 at the end of the cylindrical member.

Thus, the handle may be connected with the cylindrical fixture as shown in FIG. 33 by interlocking the toothed portion of the handle and fixture. The handle 222 is then rotated in order to rotate the fixture within the recess 210. This winding and tensioning action is shown in FIGS. 29, 30 and 31. As the fixture rotates, the sheet of fabric material is wound about the outer surface of the elongated fixture or pipe 212 to draw the sheet of fabric material 218 into the recess, thereby stretching the sheet of fabric material across its width. In this manner, the sheet, such as a billboard sign, may be tensioned across its height and width on the surface of the billboard. That is, the tensioning mechanism of FIGS. 7–9 is provided across the upper and lower edges of the billboard to stretch the sheet of material across its height, and the bracket and rotating pipe assembly of FIG. 33 is operable to stretch the sheet of fabric across its width.

The brackets 208 are preferably removably connected with the surface of the billboard by use of a bolt-like clamping mechanism 226 as shown in FIG. 33.

Finally, a latching mechanism 230 (FIG. 32) is provided to lock the handle 222 used to rotate the fixture 212 within the bracket recess 210 in a selected position. In this manner, following rotation of the fixture 212 by the handle 222 to stretch the sheet of fabric into a taut condition across its width, the latch 230 is provided to secure the handle in its wound position, thereby retaining the sheet of fabric material in a taut condition. At the corners of the billboard surface, where the C-shaped brackets 202 and the brackets 208 meet, the bracket 208 and the rigid support member 206 are provided with mating surfaces arranged at 45 degrees relative to one another as shown in FIG. 32 to form a butt joint at the corners of the billboard. Such an arrangement greatly strengthens the overall frame of the tensioning assembly, whereby the sheet of fabric material can easily be held in a taut condition, with very little play between the separate tensioning assemblies provided at the top and sides of the billboard.

The embodiment of FIGS. 1–6 employs the use of a frame to which the fabric is attached. The bracket is used to pull the frame outward and therefore stretch the skin.

The embodiment of FIGS. 7–9 also has a frame, but it pushes the frame outwardly. In addition, this embodiment utilizes a slot design to hold the fabric. This slot accommodates the thickened edge of the fabric to keep it from pulling out of the frame. At the same time it allows the fabric to shift along the length of the frame as it is stretched from either side.

The embodiment of FIGS. 24–33 applies tension by wrapping the fabric around a pipe. The pipe is then rotated on its axis which is held in place by a stationary frame. It also utilizes the slot to hold the tarp as in FIGS. 7–9. The rotation gathers up and stretches the fabric.

By combining the assemblies of FIGS. 7–9 and 24–33 into the same unit, the frame will be the full size of the sign which means corner fill-in pieces will not be necessary. The four frames of a sign also will not collide prior to stretching. Embodiment 5 has a built-in tensioning and securing mechanism with no other tools required to secure system in place. The side frame of FIGS. 24–33 is not mounted until after the top and bottom frames of FIGS. 7–9 are mounted and stretched into position. The position is pre-determined. Therefore the frame will be sized to fill in the side length. There is no collision of the side and top and bottom frame sections.

The combination of FIGS. 24–33 has two design advantages: (1) it allows the frames to be full length of the sign, thereby eliminating the corner gapping problem, and (2) it is easier to install. In general, it captures a different tensioning technology; namely, applying tension by rotation against a stationary frame.

While in the foregoing specification this invention has been described in relation to certain preferred embodiments thereof, and many details have been set forth for the purposes of illustration, it will be apparent to those skilled in the art that the invention is susceptible to additional embodiments and that certain of the details described herein may be varied considerably without departing from the basic principles of the invention.

What is claimed is:

1. A tension mounting assembly for suspending flexible sheet material in a taut condition from a generally planar support surface, comprising (a) a flexible sheet;

(b) at least one enlarged retaining means mounted on at least one peripheral edge of said flexible sheet;

(c) bracket means adapted for connection with the support surface adjacent at least one edge thereof, a first portion of said bracket means being arranged in spaced parallel relation to the support surface to define a recess open at one end adjacent the edge of the support surface, said bracket means containing a threaded opening in the other end thereof;

(d) jaw means slidably arranged within said bracket recess, said jaw means having a generally U-shaped cross-sectional configuration defining a chamber for receiving said retaining means, the open end of said jaw means being arranged normal to the open end of said bracket recess, said jaw means containing at least one opening aligned with said bracket opening; and (e) threaded adjustment means arranged within said aligned openings and rotatably operable from the open end of said recess to displace said jaw means within said recess, whereby as said jaw means is displaced inwardly within said bracket recess, said flexible sheet is pulled taut about said bracket first portion which closes said jaw opening, said sheet extending from the edge of the support surface and covering said bracket without covering said bracket recess open end, thereby to provide continuous access to said adjustment means.

2. A tension assembly as defined in claim 1, wherein said retaining means are mounted at each peripheral edge of said sheet and a plurality of bracket means are adapted for connection with the support surface at locations corresponding to each peripheral edge of said sheet.

3. A tension assembly as defined in claim 2, wherein said adjustment means comprises a bolt.

4. A tension assembly as defined in claim 3, wherein said bracket means comprises a second portion in contiguous relation with the support surface and in spaced parallel relation with said bracket first portion, said bracket first and second portions defining said recess.

5. A tension assembly as defined in claim 4, wherein said bracket means includes a third portion integrally connected with and arranged normal to said bracket second portion, said bracket third portion being adapted for connection with a side edge of the support surface.

6. A tension assembly as defined in claim 4, wherein bracket means includes a third portion integrally connected with and arranged normal to said bracket second portion, and further comprising clamping means connected with said bracket third portion for clamping said bracket means to the support surface.

7. A tension assembly as defined in claim 3, wherein said bracket means and said jaw means are elongated and extend along the sides of the support surface.

8. A tension assembly as defined in claim 7, wherein said bracket means and said jaw means contain a plurality of aligned openings for receiving a plurality of adjustment bolts, respectively.

9. A tension assembly as defined in claim 3, wherein said retaining means comprises a hem rope.

10. A tensioning assembly as defined in claim 9, wherein said jaw means includes means for retaining said rope within said chamber.

* * * * *